US005626502A

United States Patent [19]

Novey

[11] Patent Number: 5,626,502

[45] Date of Patent: May 6, 1997

[54] POWER STEERING ADAPTER FOR OUTBOARD POWERHEADS OF VARIOUS SIZE

[76] Inventor: Richard T. Novey, 688 #100 Oak Way, Eagle Lake, Calif. 96130

[21] Appl. No.: 659,870

[22] Filed: Jun. 7, 1996

[51] Int. Cl.[6] ..... B63H 5/125

[52] U.S. Cl. ..... 440/60; 114/159

[58] Field of Search ..... 440/6, 49, 53, 440/60, 61, 62, 63, 900; 248/640–643; 114/144 R, 153, 159

[56] References Cited

U.S. PATENT DOCUMENTS 5,029,547 7/1991 Novey ..... 440/60

5,358,434 10/1994 Brown ..... 440/60

5,413,062 5/1995 Koss ..... 440/60

*Primary Examiner*—Stephen Avila

*Attorney, Agent, or Firm*—William H. Maxwell

[57] ABSTRACT

An adapter for accommodating variations in size and design of outboard motor powerheads, to couple a power steering servo unit thereto, utilizing existent mounting brackets and steering brackets without restriction on powerhead use, characterized by an anchor socket pivoted on a transverse mounting bracket axis to secure a motor operated tiller member at a fixed steering position that shifts its steering center eccentrically with respect to the turning center of the powerhead, the anchor socket accommodating angular displacement caused by said eccentricity.

14 Claims, 4 Drawing Sheets

FIG. 2.

POWER STEERING ADAPTER FOR OUTBOARD POWERHEADS OF VARIOUS SIZE

BACKGROUND OF THE INVENTION

This invention relates to the remote steering control of outboard motors of different power used for the propulsion of vessels of various size. It is the adaptation of a steering servo to an outboard motor unit that is involved, the outboard motor and its accessories and controls being incorporated in the powerhead from which a drive tube depends into the water where the propeller assembly operates, and all of which is pivotally carried by a mounting bracket secured by a clamp frame to the transom of-the vessel so as to swing upwardly on a transverse axis to avoid grounding, and so as to be trimmed for optimum propulsion.

Basic steering is by means of vertical pivoting of the powerhead-drive tube-propeller assembly on the swinging bracket, with a forwardly projecting steering tiller arm and grip or handle. Power steering is by means of a servo unit, preferably electrical, with a tiller member reacting from the aforesaid mounting bracket. It is a general object of this invention to adapt such a power steering servo unit to outboard powerheads ranging in power, for example from approximately 10 HP to 27 HP, the sizes of the powerheads differing proportionately. Therefore, it is an object to compensate for off-center positioning of the servo unit with respect to the steering axis of the powerhead of whatever size within a range of sizes designed for, and to compensate for deflections that result in misalignment of the mechanical movements involved. That is, the steering center of the steering servo is not likely to be concentric with the steering center of the powerhead. However, a tight and reliable steering relationship is to be desired and is maintained, as will be shown and described.

The basic function of steering is of primary concern, it being an object of this invention to provide a hand held steering station that is extended by cable or wireless to any desired location aboard the vessel being operated thereby. The hand held station and supporting functions involving throttling, shifting, fuel and electrical battery power are state of the art, and therefore are not, shown herein.

Outboard motor powerheads are of compact design with the basic controls hereinabove referred to incorporated in the powerhead for control. The typical powerhead is enhanced by a tight fitting housing, at the immediate exterior of which all of the functional controls are accessible for direct manual operation or by remote control. It is an object of this invention to provide electrical servo steering operation controlled remotely by a mobile hand held pilot station. Electrical power for operation of this servo unit is provided by, the existent battery power supply of the outboard motor.

It is an object of this invention to adapt a steering servo to the powerhead of an outboard motor, for steering the vessel powered thereby from a remote hand held pilot station. Outboard motors of the type under consideration have a steering bracket to carry the tiller arm and with an attachment face for the connection of remote cable steering, and this steering bracket closely overlies the mounting bracket that is carried by the clamp frame. It is this steering bracket and mounting bracket relationship that is advantageously employed herein to adapt the servo unit characterized by the servo motor attached to said face of the steering bracket and by a stationary tiller member anchored to the mounting bracket.

The steering of the vessel is a constant function that requires instant response and rapid operation with substantial torque. It is an object of this invention to provide these requirements by employing a small high speed continuous duty motor with high rate gear reduction to a pinion gear that shifts the tiller member from right to left. In practice, the motor servo has a geared head with a high ratio gear train that is for all intents and purposes non-reversible. That is, the gear train effectively locks the steering position when the servo is deenergized, the small high speed motor being characterized by quick acceleration and quick deceleration as well.

The steering servo unit herein disclosed is characterized by an arcuately shaped geared segment that is shifted left to right by a motor driven pinion gear. The shiftable segment carries a tiller member in alignment with the steering center of the steering servo unit, it being an object of this invention to position said steering center approximately coincidental with the steering center lf the outboard motor powerhead. It is highly improbable that the steering center and turning center will coincide. But, it is a certainty that the steering center of the servo unit will be ahead of or behind the turning center of the powerhead. For example, FIG. 10 of the drawings illustrates a small sized powerhead adaptation with a steering center aft of the turning center; whereas FIG. 11 illustrates a large sized powerhead adaptation with the steering center forward of the turning center. It is to be observed that in either situation the steering center of the servo unit shifts laterally from the center alignment of the powerhead turning center (when turning right or left) as much as 4° to 5°. Accordingly, it is an object of this invention to provide a steering servo to powerhead adapter that compensates for angular displacements of said steering and turning centers, as is caused by the inherent eccentric relationships between these two distinct centers of -steering and turning.

SUMMARY OF THE INVENTION

An adapter is provided for the attachment of a steering servo unit to an outboard motor powerhead. Powerheads vary in power, those most extensively used raging from 10 HP to 27 HP with comensurate variation in size and position of the turning center with respect to the attachment face for steering. Therefore, it is an object of this invention to provide for a common steering servo unit that is universally applicable to said range of powerhead sizes. Accordingly, this adapter is provided that compensates for displaced positions of the steering and turning centers as caused by inherent and ever changing eccentric relationships of said two centers (steering and turning) as and when they develope whether by design or by deflections. In practice, the adapter is a swiveled socket member that swings on the horizontal pivot axis of the mounting bracket to slidably and angularly engage the tiller member of the steering servo unit. There is at least one socket, and preferably two sockets in order to increase the range of adaptability. A feature is the hanger means by which the entire steering servo unit is quickly and easily replaceably attached to the powerhead.

The foregoing and various other objects and features of this invention will be apparent and fully understood from the following detailed description of the typical preferred forms and applications thereof, throughout which description reference is made to the accompanying drawings.

THE DRAWINGS

Figure 11:
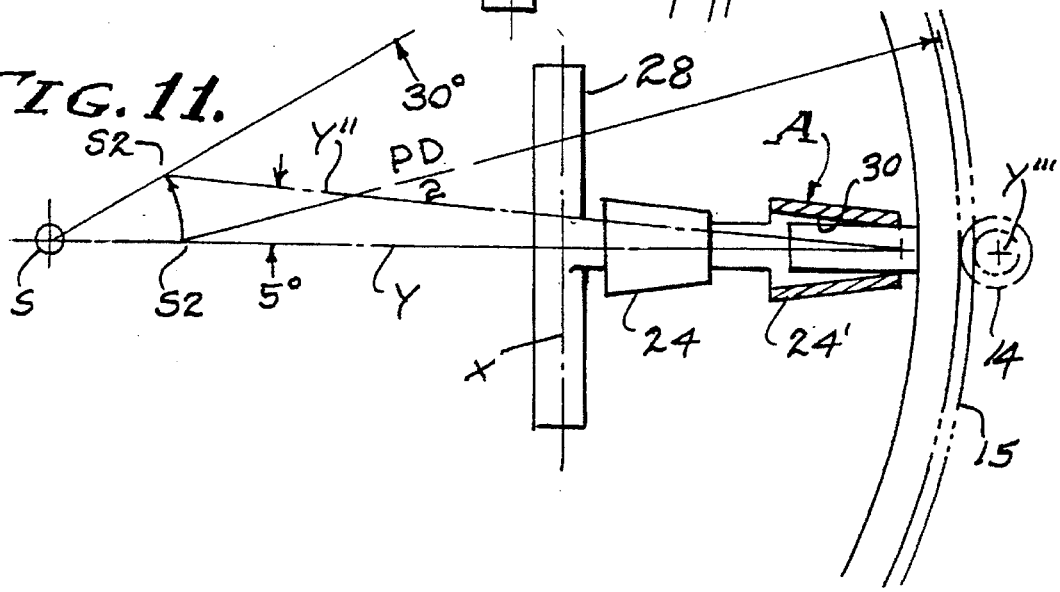

And, FIG. 11 is a diagrammatic plan view of the shiftable steering segment and its tiller member engagement with the extended socket of the adapter, illustrating the eccentric positions of the steering center and turning center, for example in a large sized 27 HP powerhead situation.

Figures 1, 2:
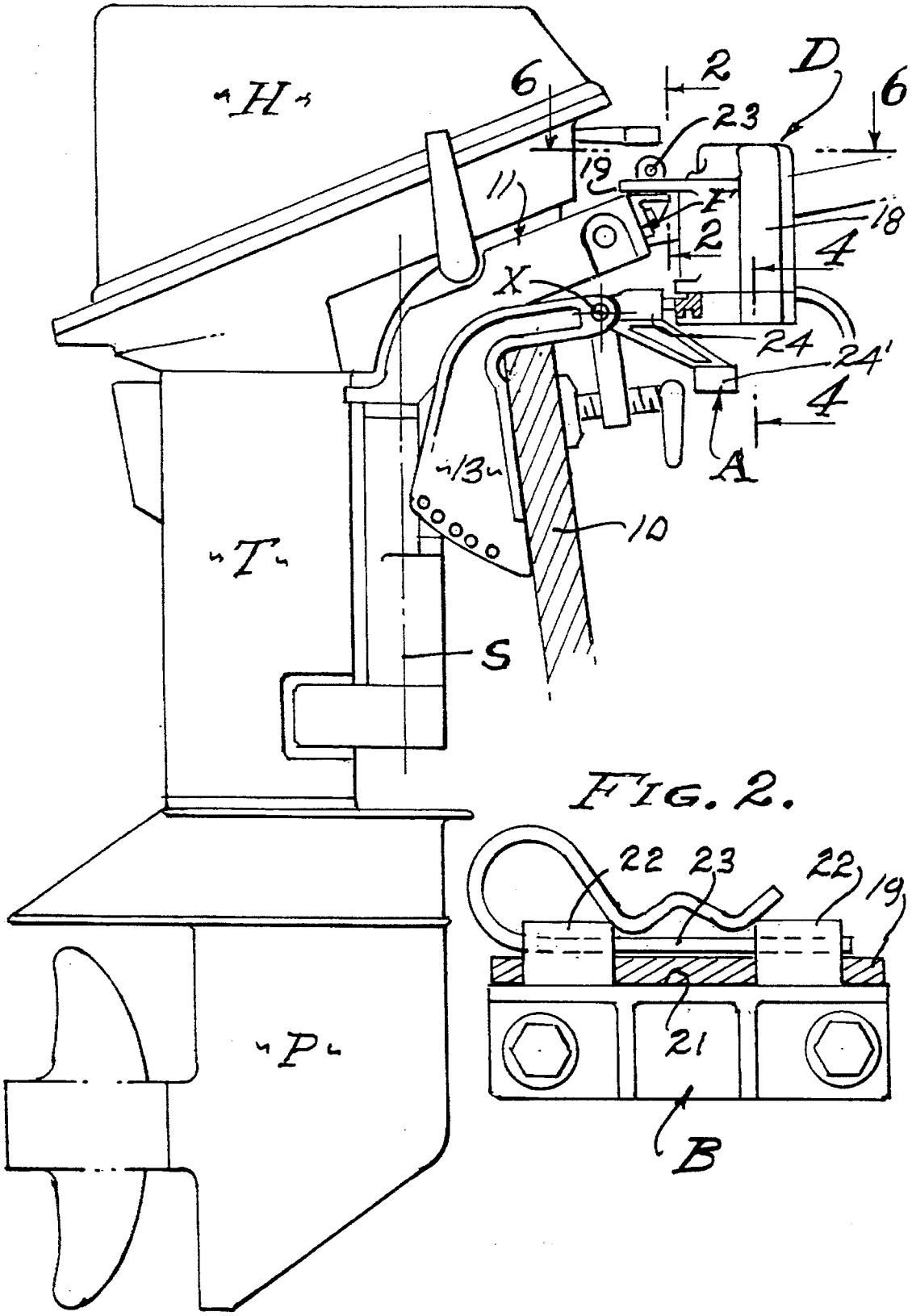
FIG. 1 is a side elevation of a typical 15 HP outboard motor powerhead mounted to the transom of a vessel by its clamp frame.
FIG. 2 is an enlarged view of the hanger means by which the steering servo unit is attached to the steering attachment face of the powerhead, taken by line 2—2 on FIG. 1.
Figure 3:
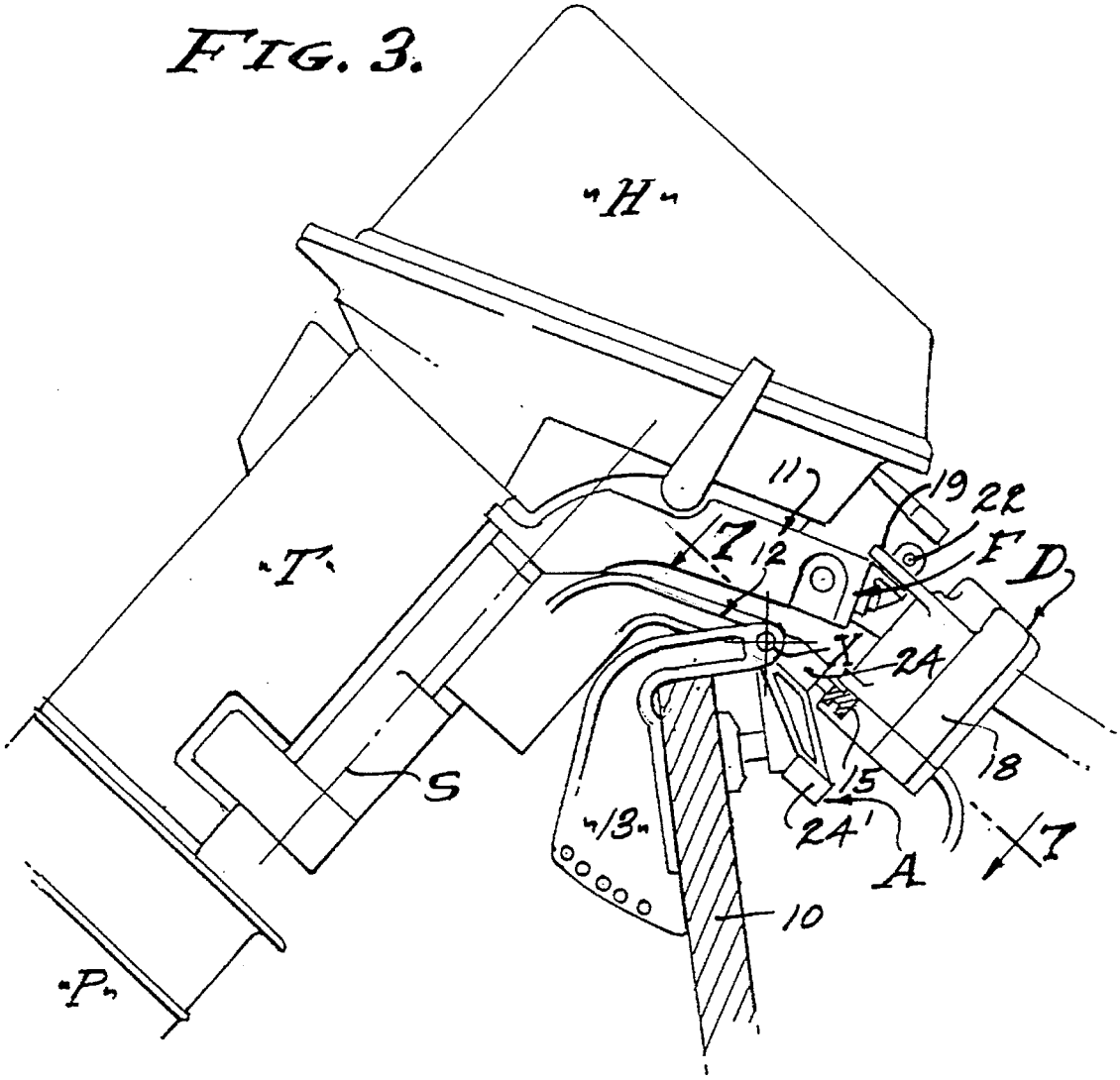
FIG. 3 is a side elevation similar to FIG. 1, illustrating a raised condition of the powerhead and articulation of the adapter that receives the tiller member of the steering servo unit.

PREFERRED EMBODIMENT:

Referring now to the drawings, FIG. 1 illustrates an outboard motor powerhead H, a drive tube T and a propeller assembly P. In accordance with this invention, the steering is by means of a steering servo means D attached to the powerhead H and having an anchored tiller member. The servo means D is characterized by an electric motor drive which is controlled by a hand held pilot station (not shown). The powerhead H and drive tube T with the propeller assembly P turn together with a steering bracket 11 on a normally vertical turning center S carried by means of a mounting bracket 12 that swings upwardly on a transverse horizontal mounting axis X and secured to the transom 10 of the vessel by means of a clamp frame 13, all in a conventional manner. The normally vertical turning center S axis is spaced a fixed distance rearward of the horizontal mounting axis X and the mounting bracket 12 rotatably carries the steering bracket 11 that supports the powerhead H to turn on said turning center S axis. Accordingly, the steering bracket 11 overlies the rearwardly extending mounting bracket 12 (see FIG. 3) and projects forwardly of the mounting axis X where it presents a steering attachment face F, all of which is state of the art design. Characteristically, the said steering attachment face F is above and forward of the mounting pivot axis X about which it swings forwardly and downwardly when tilting the powerhead H upwardly as shown in FIG. 3. The distance of face F from the turning center S axis not only varies according to the size of the powerhead, but also with different manufacturer's designs. A standard feature however is the steering attachment configuration comprised of spaced fastener openings for threaded attachment of state of the art cable steering. Said distance from the turning center to the steering attachment face will vary from approximately 5 to 11 inches in the range of powerheads here under consideration.

Figure 10:
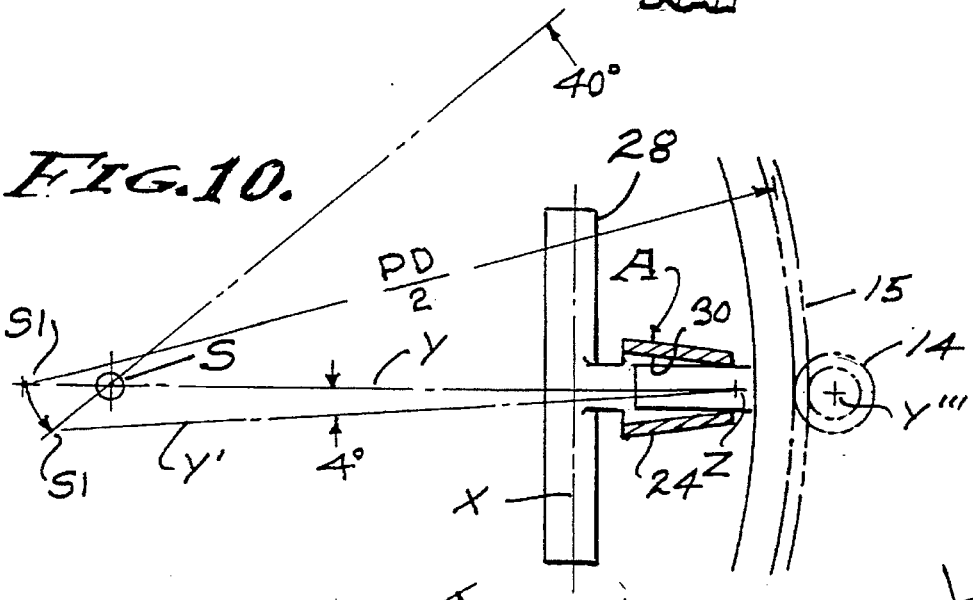
FIG. 10 is a diagrammatic plan view of the shiftable steering segment and its tiller member engaged with the socket of the adapter, illustrating the eccentric positions of the steering center and turning center, for example in a moderate sized 15 HP powerhead situation.

Referring now to the steering servo means D, a reversible motor M attached to the face F positionably rotates a drive pinion gear 14 that shifts the servo unit D right or left to turn on a vertical steering center S1 axis as shown in FIG. 10, of S2 as shown in FIG. 11. The gear segment 15 is an arcuate rack or the like, and the driving pinion gear 14 is reversibly rotated through a gear reduction means 16. This gear rack segment 15 is concentric with the steering center S1 and S2 and carries a short rearwardly disposed tiller member 17 in the form of a pin that terminates intermediate the segment gear 15 and said steering center S1 or S2. The normally vertical axes of steering centers S1 or S2 are spaced a fixed distance rearward of the arcuate pitch diameter of the segment gear 15. And the extended axis of the member 17 or pin extends to the steering center as clearly shown in the drawings (see FIGS. 10 and 11). Said distance from the steering center to the pitch diameter of the segment gear 15 is fixed, for example at 10 inches.

The motor drive to the pinion gear 14 is through reduction gearing 16 housed in a protective case 18 secured by a mounting flange 19 attached to the face F of the steering bracket 11. In practice, the gear reduction from the motor shaft to the pinion gear is approximately 150 to 1, for discrete locked positioning of the powerhead. The case 18 is fixedly mounted by the flange 19 to move with the steering bracket, and the pinion gear 14 is exposed rearwardly through a transversely open slot 20 to pass the tiller member 17 that is centrally anchored by the adapter A.

The gear segment 15 is flexible to the extent that it can be directed into uniform engagement with the pinion gear 14 by guide means in the case 18. In practice, the gear segment 15 is made of plastic material such as Teflon or Nylon (trademarks) which are tough flexible materials with substantial physical properties, so that it can be trained through guide means regardless of limited deflections imposed upon the powerhead H and steering servo means D structures. As shown, the guide means is comprised of a bottom guide rail on the case 18 engaged by a mating groove in the segment gear 15. The rail and groove are arcuately concentric with the steering center S1 and S2 axes, and so as to maintain proper mesh with the pinion gear 14. The high ratio gear reduction is self locking, so as to hold whatever steering position is set thereby. The servo motor is a small fractional horsepower motor that is reversible and quick to accelerate and decelerate.

Means for rigidly attaching the steering servo means D to the steering attachment face F is provided in the form of the hanger means B. Regardless of the angularly disposed face F, other than vertical and not necessarily parallel with the turning center S, the servo case 18 is fixedly mounted to the steering bracket 11 so that the axis of the pinion 14 is and remains parallel with said turning center axis. Since the segment gear 15 is directly meshed with pinion gear 14, it too is and remains parallel with said turning center, as is clearly shown in FIGS. 1 and 3. Accordingly, the hanger means B is rigidly affixed to the attachment face and the servo means D fixed thereto.

The servo means D is releasably attached to the hanger means B that presents an upwardly disposed planar surface 21 from which a lug 22 projects vertically to engage through the mounting flange 19 of the servo unit and secured by a keeper pin 23 engaged through the lug and holding the flange 19 against the hanger surface 21. In practice, there are spaced lugs 22 through which the keeper pin 23 is releasably engaged, the lugs preventing turning of the servo unit when torque is applied thereby (see FIG. 2). Accordingly, the turning axis of the powerhead H, the steering center axis of the segment gear 15 and its tiller pin 17, and the drive axis Y'" of the servo pinion gear 14 are all and remain parallel one with the other, regardless of the tilt position of the outboard motor powerhead H. However, the axes of S and S1 or S2 are not necessarily concentric and are most probably considerably eccentric as illustrated in FIGS. 10 and 11.

Figure 4:
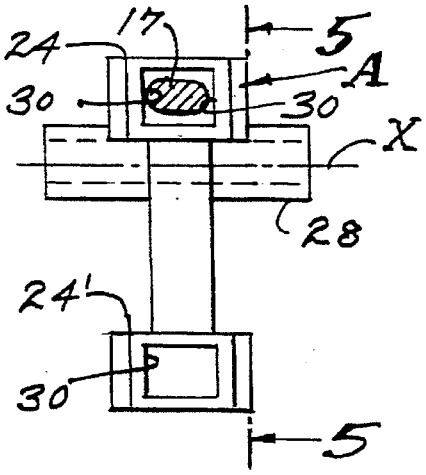
FIG. 4 is an enlarged front end view of the adapter and its reception of the tiller member, taken as indicated by line 4—4 on FIG. 1.
Figure 5:
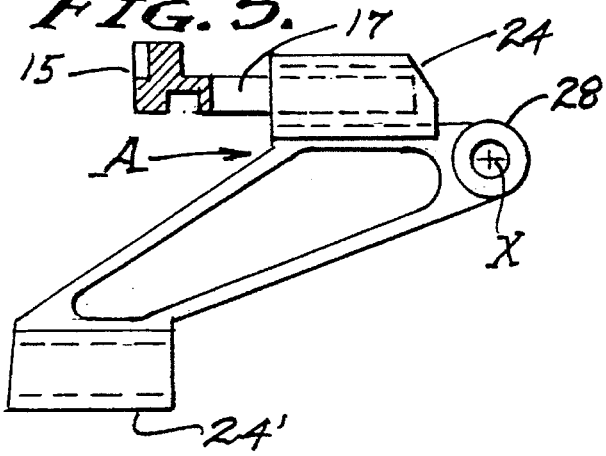
FIG. 5 is a side view of the adapter and its reception of said tiller member, taken as indicated by line 5—5 on FIG. 4.
Figures 6, 7:
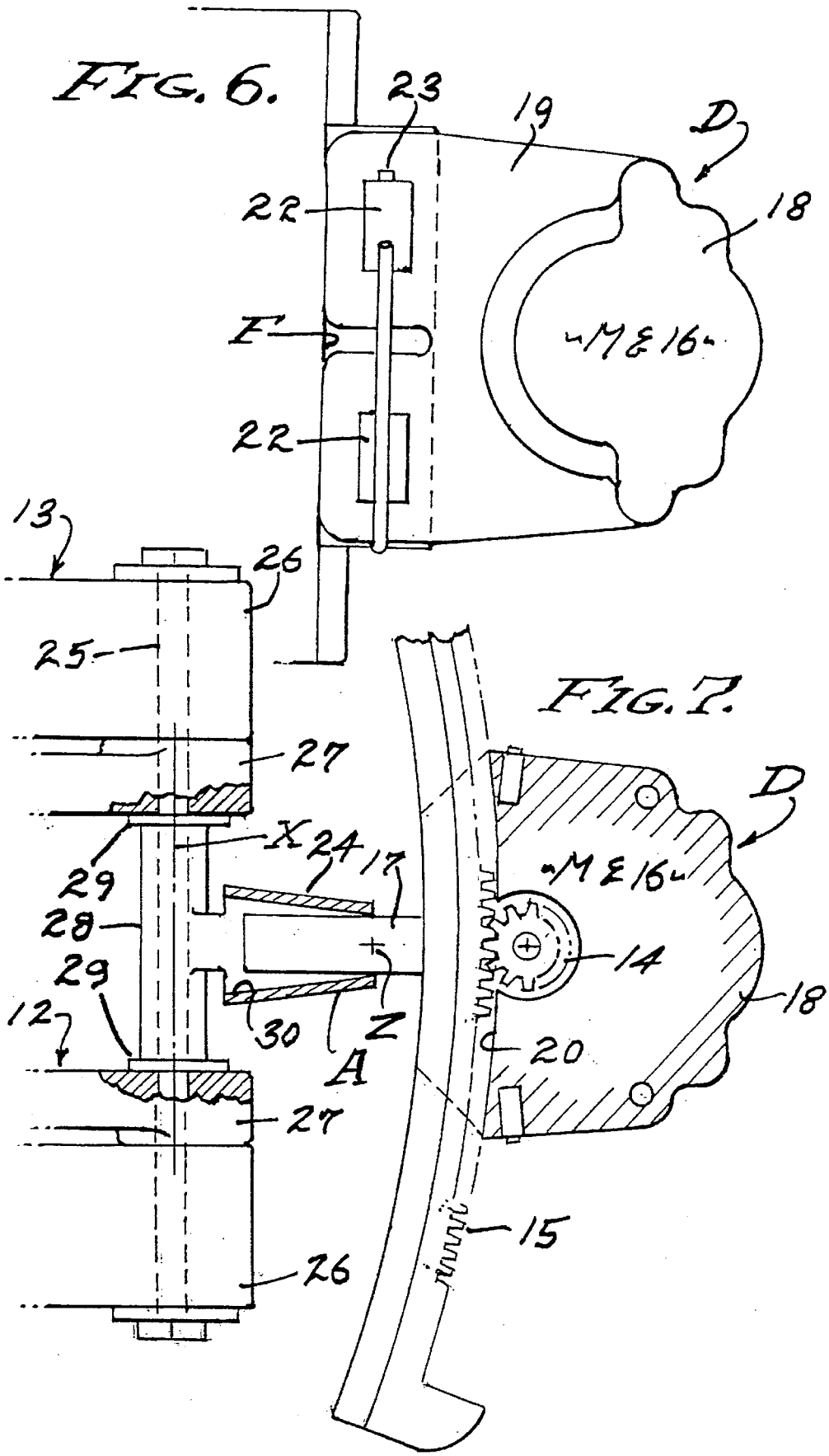
FIG. 6 is an enlarged plan view of the steering servo unit and its attachment to the hanger mean, taken as indicated by line 6—6 on FIG. 1.
FIG. 7 is an enlarged sectional view of the steering servo unit and the reception of its tiller member in the socket of the adapter, taken as indicated by line 7—7 on FIG. 3.

In accordance with this invention, I provide an adapter A having a steering anchor socket 24 pivotally carried on the mounting axis X that rotatably connects the mounting bracket 12 and clamp frame 13. As shown in FIG. 7 an elongated pivot shaft or bolt 25 extends between spaced arms 26 of said clamp, and upon which spaced arms 27 of said mounting bracket 12 are pivoted. The adapter A is comprised of a mounting tube 28 centered between the arms 27 by thrust washers 29, and the anchor socket 24 of the adapter is carried by and projects forwardly from said mounting tube, so as to slidably receive the aforesaid tiller pin 17 (see FIG. 5). It is to be understood that the distance between the pitch diameter of gear segment 15 and the mounting center X will vary from one powerhead to another, and from one manufacturer to another, and also do to inaccuracies and structural deflections. Accordingly, the tiller pin 17 enters the steering anchor socket 24 to whatever depth or extent as circumstances require. In practice, said anchor is in the form of a socket that lies above the mounting tube 28, so that the tiller pin member can extend over said mounting when necessary (see FIGS. 4 and 5).

As shown herein, the adapter A has a plurality of two anchor sockets 24 and 24', both alike but placed for different sized powerheads H. The anchor socket 24' is placed forward of and downward from the placement of anchor socket 24 in order to accommodate a larger powerhead.

Referring now to FIGS. 10 and 11 of the drawings, the anchor socket 24 opens at the distal front end plane Z that slidably fits the cross section of the tiller pin 17 by which said pin is pivotally engaged. FIG. 10 illustrates the geometry involved with a 15 HP powerhead H, in which case the steering center S1 is aft of the powerhead turning center S. Therefore, centers S and S1 are eccentric so that the axis of the tiller pin 17 becomes increasingly angularly related to the radius of the steering gear segment 15, as and when turning positions are increasingly applied to said powerhead.

In the example shown in FIG. 10, a 40° turning position to the left (a starboard turn) shifts the steering center S1 to the right 40°, and this shifts the steering radius Y' approximately 4°; moving the tiller pin 17 out of alignment with the turning radius Y. This angular displacement of the tiller pin 17 within the anchor socket 24 is accommodated by the rearwardly divergent side walls 30 of said socket. In practice, the socket walls diverge at least 4° from the radius Y, or at an included angle of at least 8°, in the particular embodiment shown in FIG. 10.

The example shown in FIG. 11 illustrates the geometry involved with a 27 HP powerhead H, wherein a 30° turning position to the left (a starboard turn) shifts the steering center S2 to the left 30°, and this shifts the steering radius Y" approximately 5°; moving the tiller pin 17 out of alignment with the turning radius Y. This angular displacement of the tiller pin 17 within the anchor socket 24 is accommodated by the rearwardly divergent side walls 30 of said socket. In practice, the socket is divergent at least 5° from the radius Y, or at an included angle of at least 10°, in the particular embodiment shown in FIG. 11.

Figure 9:
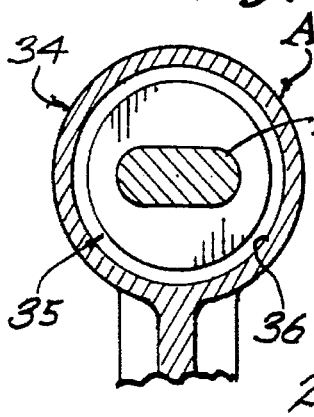
Figure 8:
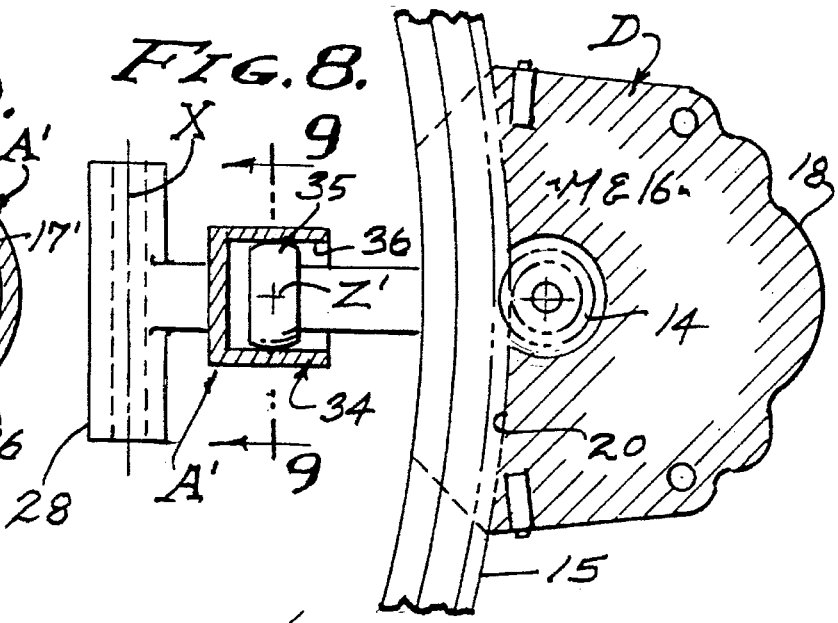
FIG. 8 is an enlarged sectional view similar to FIG. 7, illustrating a modified omnidirectional engagement of the tiller member and adapter socket. And, FIG. 9 is an enlarged detailed sectional view taken as indicated by line 9—9 on FIG. 8.

Referring now to a second embodiment of the adapter A' and to FIGS. 8 and 9 of the drawings, an anchor socket 34 slidably and pivotally receives a spherically shaped member 35, in the form of a truncated ball, carried at the rearmost end of the tiller member 17'. The inner wall or walls 36 of the socket 34 can be polygonal with each face thereof tangent to the periphery of the spherical member 35. And as shown, the socket 34 is preferably a right cylinder wall 36 that has coextensive circumferential sliding engagement with the periphery of the member 35. Accordingly, the tiller member 17' is both longitudinally shiftable and omni pivotal within the cylinder wall 36, to thereby accommodate variations and deflections that will occur.

Having described only the preferred forms and applications of my invention, I do not wish to be limited or restricted to the specific details herein set forth, but wish to reserve to myself any modifications or variations that may appear to those skilled in the art as set forth within the limits of the following claims.

I claim:

1. An adapter for the coupling of a power steering servo unit to a mounting bracket of an outboard motor powerhead to steer a boat;

the outboard motor powerhead being carried by a mounting bracket pivoted on a horizontal transverse mounting axis to a clamp frame secured to the boat and having a turning center axis from which a steering bracket extends forwardly, the steering bracket and powerhead turning center axis being adapted to swing with the mounting bracket about said transverse axis, the power steering servo unit having a reversible motor fixed to the steering bracket and with a drive pinion on a drive axis and a segment gear meshed therewith to shift the servo unit transversely about a steering center axis parallel to and eccentrically spaced from said turning center axis of the mounting bracket, there being a tiller member extending rearwardly from the segment gear and in radial alignment with said steering center axis, the adapter for coupling of the servo unit being comprised of a mounting tube rotatable on the horizontal transverse mounting axis, and a forwardly open anchor member carried by the mounting tube and having an anchor socket slidably receiving the rearwardly extending tiller member and pivotally engaged with said tiller member for lateral angular displacement of the tiller member within the anchor socket, whereby lateral displacement of the steering center axis from the turning center axis is accommodated for when the powerhead is turned.

2. The adapter for the coupling of the power steering servo unit to the mounting bracket of an outboard motor powerhead, as set forth in claim 1, wherein the anchor socket has rearwardly divergent side walls for accommodating lateral angular displacement of the tiller member within the anchor socket.

3. The adapter for the coupling of the power steering servo unit to the mounting bracket of an outboard motor powerhead, as set forth in claim 1, wherein the anchor socket has opposite side walls engageable with opposite sides of the tiller member at a distal front opening plane of the anchor socket, said opposite side walls being rearwardly divergent from said distal front plane for accommodating lateral angular displacement of the tiller member within the anchor socket.

4. The adapter for the coupling of the power steering servo unit to the mounting bracket of an outboard motor powerhead, as set forth in claim 1, wherein the anchor socket has opposite side walls rearwardly divergent from a distal front opening plane of the anchor socket for sliding engagement with opposite sides of the tiller member for accommodating lateral angular displacement of the tiller member.

5. The adapter for the coupling of the power steering servo unit to the mounting bracket of an outboard motor powerhead, as set forth in claim 1, wherein the anchor socket has opposite side walls rearwardly divergent from a distal front opening plane of the anchor socket for pivotal engagement with opposite sides of the tiller member for accommodating lateral angular displacement of the tiller member.

6. The adapter for the coupling of the power steering servo unit to the mounting bracket of an outboard motor powerhead, as set forth in claim 1, wherein the anchor socket has opposite side walls rearwardly divergent from a distal front opening plane of the anchor socket for sliding and pivotal engagement with opposite sides of the tiller member for accommodating lateral angular displacement of the tiller member.

7. The adapter for the coupling of the power steering servo unit to the mounting bracket of an outboard motor powerhead, as set forth in claim 1, wherein the anchor socket is comprised of side walls having centering engagement with the tiller member and rearwardly divergent for accommodating lateral angular displacement of the tiller member within the anchor socket.

8. The adapter for the coupling of the power steering servo unit to the mounting bracket of an outboard motor powerhead, as set forth in claim 1, wherein the anchor socket is comprised of sidewalls having centering pivotal engagement with a spherical rear end portion of the tiller member for accommodating lateral angular displacement of the tiller member within the anchor socket.

9. The adapter for the coupling of the power steering servo unit to the mounting bracket of an outboard motor powerhead, as set forth in claim 1, wherein the anchor socket is comprised of sidewalls having centering sliding and pivotal engagement with a spherical rear end portion of the tiller member for accommodating lateral angular displacement of the tiller member within the anchor socket.

10. The adapter for the coupling of the power steering servo unit to the mounting bracket of an outboard motor powerhead, as set forth in claim 1, wherein the anchor socket is comprised of side walls having centering sliding engagement with a spherical rear end port of the tiller member for accommodating lateral angular displacement of the tiller member within the anchor socket.

11. The adapter for the coupling of the power steering servo unit to the mounting bracket of an outboard motor powerhead, as set forth in claim 1, wherein the anchor socket is comprised of a right cylinder side wall having sliding centered engagement with a spherical rear end portion of the tiller member for accommodating omni angular displacement of the tiller member within the anchor socket.

12. The adapter for the coupling of the power steering servo unit to the mounting bracket of an outboard motor powerhead, as set forth in claim 1, wherein the anchor socket is comprised of a right cylinder side wall having pivotal centered engagement with a spherical rear end portion of the tiller member for accommodating omni angular displacement of the tiller member within the anchor socket.

13. The adapter for the coupling of the power steering servo unit to the mounting bracket of an outboard motor powerhead, as set forth in claim 1, wherein the anchor socket is comprised of a right cylinder side wall having sliding and omni pivotal centered engagement with a spherical rear end portion of the tiller member for accommodating omni angular displacement of the tiller member within the anchor socket.

14. The adapter for the coupling of the power steering servo unit to the mounting bracket of an outboard motor powerhead, as set forth in claim 2, wherein the anchor socket walls are rearwardly divergent at an included angle in the range of 8° to 10°.

* * * * *